US007175141B2

(12) United States Patent
Bolinder et al.

(10) Patent No.: US 7,175,141 B2
(45) **Date of Patent: *Feb. 13, 2007**

(54) REMOVABLE SIGN SUPPORT SYSTEM

(76) Inventors: Bruce Bolinder, 22 Millpond, Stansbury Park, UT (US) 84074; Joe Bolinder, 214 W. Utah Ave., Tooele, UT (US) 84074

( * ) Notice: Subject to any disclaimer, the term of this patent is extended or adjusted under 35 U.S.C. 154(b) by 9 days.

This patent is subject to a terminal disclaimer.

(21) Appl. No.: 11/057,054

(22) Filed: Feb. 11, 2005

(65) Prior Publication Data

US 2005/0211857 A1 Sep. 29, 2005

Related U.S. Application Data

(63) Continuation-in-part of application No. 10/419,363, filed on Apr. 18, 2003, now Pat. No. 6,910,664.

(51) Int. Cl.
*A47F 3/44* (2006.01)

(52) U.S. Cl. ..... 248/156; 40/607.09

(58) Field of Classification Search ..... 248/156, 248/545, 161, 188.5, 507, 508, 509, 530; 40/607.04, 607.06, 607.05, 607.01, 606.18; 254/30, 31; 173/90, 91

See application file for complete search history.

(56) References Cited

U.S. PATENT DOCUMENTS 1,427,576 A 8/1922 Bryant
1,761,675 A 6/1930 Mick
3,712,652 A * 1/1973 Uilkema ..... 403/108
4,161,310 A 7/1979 Parker
4,242,822 A * 1/1981 Black ..... 40/607.06
4,249,715 A * 2/1981 Repp ..... 248/545
4,326,352 A * 4/1982 Barth ..... 40/607.06
4,343,449 A * 8/1982 Osthus ..... 248/156
4,357,001 A * 11/1982 Schmanski et al. ..... 256/51
4,378,650 A * 4/1983 Ottoson ..... 40/607.08
4,422,621 A * 12/1983 Ekern ..... 254/30
4,483,506 A * 11/1984 Litwiller ..... 248/545
4,726,565 A 2/1988 Keller
4,738,433 A 4/1988 Hoff
4,910,901 A * 3/1990 Boyar ..... 40/607.06
4,910,902 A * 3/1990 Anderson ..... 40/607.06
4,923,157 A * 5/1990 Belamiza ..... 248/188.2
D312,196 S 11/1990 Norona
5,022,632 A 6/1991 Beideck
5,042,591 A * 8/1991 Hull ..... 173/91
5,113,627 A * 5/1992 Jarrett, Sr. ..... 52/157
5,123,623 A * 6/1992 McNamara ..... 248/545
5,161,781 A * 11/1992 Sohocki ..... 254/30

(Continued)

*Primary Examiner*—Ramon O Ramirez
(74) *Attorney, Agent, or Firm*—David R. McKinney

(57) ABSTRACT

A removable sign support system for supporting a sign on the ground includes a substantially upright support post, configured to removably receive a sign post. The support post has a substantially horizontal base affixed to its bottom end, with a plurality of spikes downwardly extending from the base into the ground, and a lifting connection fixedly attached to the support post. A removal device is provided for removing the support post from the ground, and includes a moveable column having a bottom end configured to bear upon the top of the ground near the base of the support post, and a lever arm pivotally attached to the moveable column. The removal device is configured to pull the spikes upwardly out of the ground by engaging the lever arm with the lifting connection and applying a substantially upward force thereon.

21 Claims, 5 Drawing Sheets

U.S. PATENT DOCUMENTS 5,186,437 A 2/1993 Scott
5,224,687 A 7/1993 Geckler et al.
5,305,976 A * 4/1994 Blanchard ..... 248/156
5,368,277 A * 11/1994 Moss ..... 254/30
5,464,192 A * 11/1995 Burnham ..... 254/30
5,499,795 A * 3/1996 Mathews ..... 254/30
5,502,910 A * 4/1996 Lucchesi ..... 40/607.06
5,529,287 A * 6/1996 Pelosi et al. ..... 254/129
5,597,151 A 1/1997 Duncan
5,681,030 A * 10/1997 Nall ..... 254/30
5,713,559 A * 2/1998 McClarin et al. ..... 254/124
5,794,918 A 8/1998 Price
5,833,215 A * 11/1998 Vandenburg ..... 254/30
5,865,490 A * 2/1999 Vowell ..... 294/57
5,903,991 A * 5/1999 Sasse ..... 40/607.04
5,904,115 A * 5/1999 Durbin et al. ..... 116/28 R
2002/0088157 A1* 7/2002 Winterton et al. ..... 40/610
2002/0139548 A1* 10/2002 Connelly, Jr. ..... 173/90

* cited by examiner

REMOVABLE SIGN SUPPORT SYSTEM

This application is a continuation-in-part of U.S. patent application Ser. No. 10/419,363, now U.S. Pat. No. 6,910,664, filed on Apr. 18, 2003, and entitled REMOVABLE SIGN SUPPORT SYSTEM.

BACKGROUND OF THE INVENTION

1. Field of the Invention

The present invention relates generally to sign structures. More particularly, the present invention relates to a sign support system having a removable sign support structure and a freestanding lever arm sign removal device.

2. Related Art

Some types of signs, such as real estate for-sale signs, are frequently and repeatedly placed and removed. Naturally, their placement must provide sufficient strength to support the sign in its upright position, and to resist wind and other possible loads. However, it is desirable that these signs be reasonably easy to place and remove, and durable enough to be placed removed without substantial damage to the sign so that they can be reused many times. Sometimes temporary signs are placed or removed by persons who may be small or lack sufficient strength by themselves to properly install or remove the sign, and who may be working alone. For example, real estate agents frequently place and remove for-sale signs. Some of these signs must be strong enough to stand for many months or years. Additionally, these signs must sometimes be placed in hard or frozen ground.

Unfortunately, many removable signs that are now known are difficult to adequately install, and once installed properly, are difficult to remove, even by persons with substantial physical strength. Moreover, the configuration of some removable signs makes them highly susceptible to damage during installation and/or removal.

SUMMARY OF THE INVENTION

It has been recognized that it would be advantageous to develop a removable sign system that can be securely installed in the ground and quickly and easily removed by a single person with relatively limited strength.

The invention advantageously provides a removable sign support system for supporting a sign on the ground. The system includes a substantially upright support post, configured to removably receive a sign post. The support pose has a substantially horizontal base affixed to its bottom end, and a plurality of spikes downwardly extending from the base into the ground. A lifting connection is fixedly attached to the support post. A removal device is provided for removing the support post from the ground. The removal device includes a moveable column having a bottom end configured to bear upon the top of the ground near the base of the support post. A lever arm is pivotally attached to the moveable column, and is configured to pull the spikes upwardly out of the ground by engaging and applying a substantially upward force upon the lifting connection.

Additional features and advantages of the invention will be apparent from the detailed description which follows, taken in conjunction with the accompanying drawings, which together illustrate, by way of example, features of the invention.

DETAILED DESCRIPTION

Figure 1:
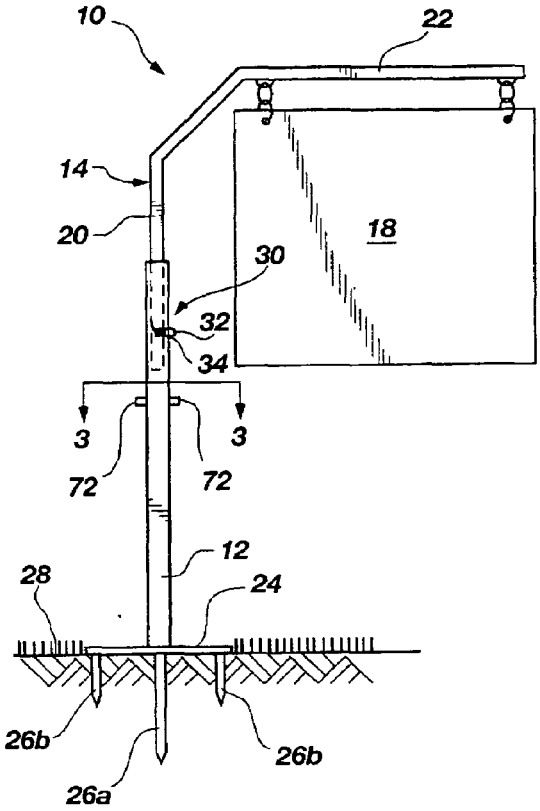
FIG. 1 is a front view of one embodiment of a sign support system in accordance with the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
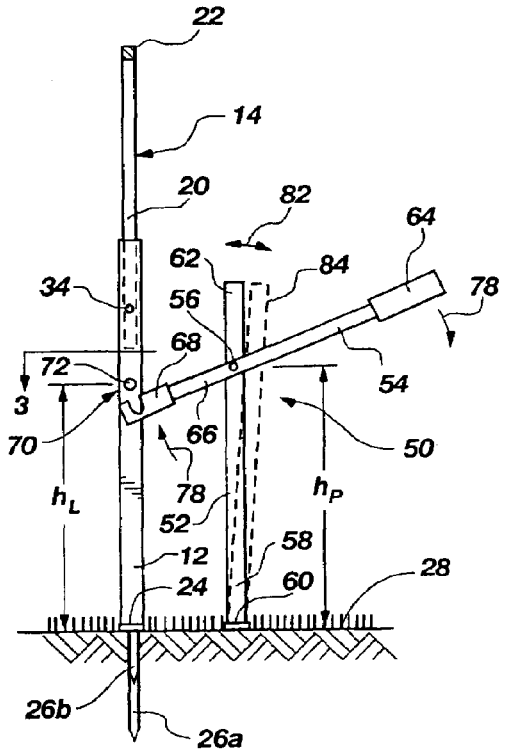
FIG. 2 is a side view of the sign support system of FIG. 1.

As illustrated in FIGS. 1 and 2, the present invention provides a removable sign support system, indicated generally at 10, comprising an upright support post 12, and a removable sign post 14. The upright support post is a metal tube, such as a square steel tube as shown, with a central aperture 16 that is open at its top for receiving the lower end of the sign post. It will be apparent that other post shapes may be used, such as round tubes, hexagonal tubes, etc. The sign post is of the same shape as the support post, and is configured to telescopically slide into the top of the support post. The sign post is configured to directly support a sign 18, such as a "For Sale" sign. In the configuration shown, the sign post has an inverted "L" shape, having a vertical portion 20 that fits into the support post, and a horizontal arm 22 from which the sign hangs. It will be apparent that the sign could take many other configurations as well.

Fixedly attached to the bottom of the support post is a transverse base plate 24, such as a flat steel bar, with several downwardly directed ground spikes, indicated generally at 26, for penetrating into the ground 28. In the embodiment shown, the ground spikes include a longer center spike **26*a* directly below the support tube, and two shorter stabilizer spikes 26*b* located at opposing extremities of the base support. Other spike configurations may also be used. These spikes secure the upright support post 12** in the ground, and, in combination with the wide stance of the base plate, help resist overturning moments due to wind, impact, and other forces.

Near the top of the upright support post 12 is a detent 30 for positioning and holding the sign post 14 within the support post. The detent includes a spring-loaded detent pin 32 attached to the lower end of the vertical portion 20 of the sign post, and a corresponding detent hole 34 extending through a side of the upright support post. To insert the sign post into the support post, a user depresses the detent pin into the lower end of the sign post, then inserts the lower end of the sign post into the top of the support post so that the detent pin and detent hole can come into alignment. Advantageously, the exposed end of the detent pin is rounded, such that it slides easily within the larger support tube, notwithstanding that it presses against the inside of the support tube as it slides. When the detent pin reaches a position where it is aligned with the detent hole, the pin snaps through the hole and locks the two tubes into position with respect to each other. To remove the sign post from the support post, the user simply presses the detent pin into the detent hole while pulling on the sign post, so that the sign post can be slidingly removed from the support post in the opposite manner of its insertion.

It will be apparent that some types of signs, such as real estate for-sale signs, are frequently and repeatedly placed and removed. Naturally, their placement must provide sufficient strength to support the sign and to resist wind and other possible loads, yet be reasonably easy to remove. At the same time, these signs frequently must be placed or removed by persons who may be small or lack sufficient strength by themselves to properly install or remove the sign, and who may be working alone. Advantageously, the removable sign system of the present invention is configured to be securely installed and quickly removed by a single person of relatively limited strength.

Insertion of the support post 12 into the ground can be accomplished in several ways. The particular method chosen may depend upon the hardness of the ground or the strength of the user. Because the base plate 24 is a relatively rigid metal bar, a user may simply step or stand upon the base plate while holding the support post substantially upright, so as to drive the spikes 26 into the ground using their body weight. The effectiveness of this method may depend on the weight of the user and the type of shoes they are wearing. It will be apparent that this method may be ineffective for a petite woman in high-heeled shoes, for example. Alternatively, a user could use a hammer or other similarly useful tool to pound upon the base plate and drive the spikes into the ground. It will be apparent, however, that driving the spikes by this latter method may tend to tilt the support post, given that the exposed portions of the base plate are not aligned with the vertical axis of the support post.

Figure 5:
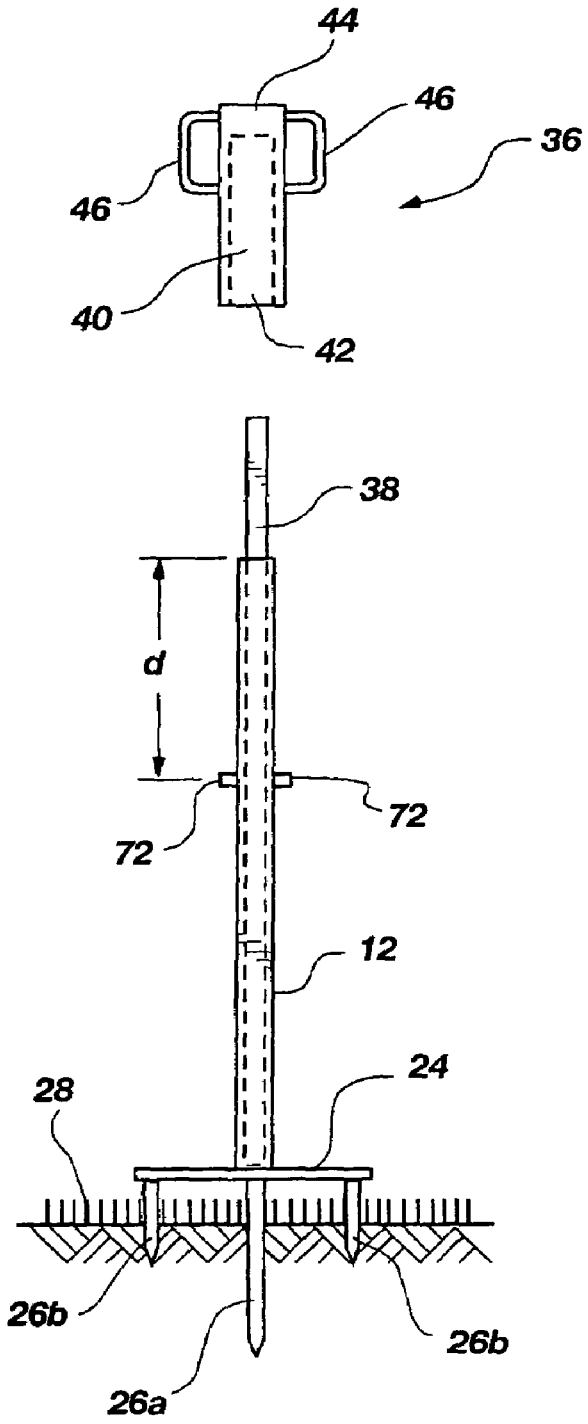
FIG. 5 is a front view of the support post configured to be driven into the ground.

Referring to FIG. 5, the support post 12 may alternatively be set in the ground using a post hammer 36 and hard steel driving rod 38. The post hammer comprises a strong metal tube 40 with an open bottom end 42 and a closed top end 44. Disposed along the two sides of the tube are handles 46. To drive the support post into the ground, the driving rod is inserted into the central aperture 16 of the support post. The driving rod is long enough to contact the top of the base plate 24 inside the bottom end of the support post, and also extend above the top of the support post. The driving rod provides a strong structure against which the post hammer can strike without damaging the top of the support post. When the post hammer strikes the top of the driving rod, the thick, heavy closed top end of the post hammer strikes the top of the driving rod, which bears against the base plate, and drives the spikes into the ground.

In one embodiment, the ends of the driving rod 38 are tapered to a smaller cross-section than in the middle. This feature provides several advantages. First, it allows the driving rod to fit into the support post 12 even if the end happens to become slightly mushroomed due to pounding. Second, the taper at the bottom end allows the driving rod to more likely bear upon the base plate 24 itself, rather than possibly on weld material connecting the support post to the base plate. Additionally, the tapered end of the driving rod makes it easier to insert into the support post.

Figure 3:
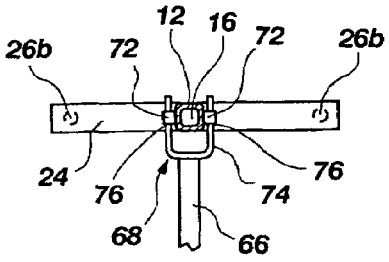
FIG. 3 is a top cross-sectional view of the sign support system of FIG. 1, showing the engagement end of the lever arm engaged with the lifting pins.
Figure 4:
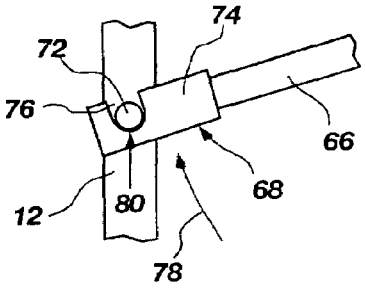
FIG. 4 is a side detail view of the engagement end of the lever arm.

Regardless of the method chosen to install the support post 12, when it is time to remove the sign from the ground, this can be difficult, even for persons of substantial physical strength. Referring to FIGS. 2–4, the removable sign support system 10 of the present invention includes a sign removal device 50. The removal device includes a portable or moveable column 52, with a lever arm 54 pivotally attached thereto at a pivot point 56. The bottom end 58 of the column includes a ground plate 60 configured to support the column on the surface of the ground 28. The size of the ground plate can be selected to provide sufficient load-bearing area so that the column of the removal device will not sink into the ground excessively when expected loads are placed upon the removal device. The top end 62 of the column extends a distance above the pivot point, and provides a convenient location for a user to grip the column to hold it and steady it.

The lever arm 54 includes a handle end 64 on one side of the pivotal attachment, and an engagement end 66 on the opposite side of the pivotal attachment. In order to provide leverage or mechanical advantage, the distance from the pivot point 56 to the end of the handle is preferably longer than distance from the pivot point to the engagement end. In one embodiment, the length of the handle end is approximately twice the length of the engagement end.

The engagement end includes a forked hook 68 that is configured to engage a removal connector 70 disposed on the support post 12. In the embodiment shown, the removal connector comprises a pair of lift posts 72 extending from opposing sides of the support post. The lift posts are fixedly attached to the support post, and provide secure lifting points for being engaged by the forked hook 68. Referring to FIGS. 3 and 4, the forked hook comprises a U-shaped member 74 that is fixedly attached to the lever arm, with a pair of rounded-bottom lift slots 76 disposed in opposing sides of the fork. The fork is configured to fit around the outside of the support post, so that the lift slots may be engaged with the lift pins from below. The lift slots may also be tapered, as shown, to facilitate easy sliding insertion of the lift pins into the slots.

Referring back to FIG. 2, to remove the support post 12 from the ground, the user places the ground plate 60 of the removal device 50 on the ground near but spaced away from the base plate 24 of the support post. The lateral distance between the base plate of the support post and the bearing position of the ground plate of the removal device should be chosen to allow the lift slots 76 of the forked hook to engage the lift posts 72 from below when the lever arm 54 is rotated in the directions of arrows 78, while still keeping the column 52 substantially vertical. When the lift slots engage the lift posts, the mechanical advantage of the lever arm allows the user to apply an upward force on the support post that is much greater than the downward force the user applies to the handle of the lever arm.

Advantageously, the lift posts 72 are symmetrically disposed on opposite sides of the support post, such that simultaneous upward force on these posts imposes a substantially upward force on the support post, without bending, twisting, or pushing the post laterally.

The imposition of a substantially upward force can be further facilitated by the user laterally moving the top of the column 52 very slightly so that the rounded bottom end 80 of the lift slots 76 engages the lift posts at a point that is as close as possible to the true bottom point of the lift posts. There are a couple of considerations related to the vertical position of the lifting posts 72 along the support post. On the one hand, as shown in FIG. 5, the lifting posts are placed a distance d below the top of the support post so that the post hammer will not strike and damage them when it is brought down upon the top end of the driving rod. At the same time, referring to FIG. 2, the vertical height $h_L$ of the lifting posts 72 relative to the surface of the ground 28 (i.e. relative to the bottom of the base plate 24) is preferably less than the height $h_p$ of the pivot point above the ground plate 60 of the removal device 50. This causes the engagement end of the lever arm to engage the lifting posts when the handle of the lever arm is in a relatively high position, providing ample room for the handle to swing downward as the lever arm is rotated to draw the support post out of the ground. In one embodiment, the height of the pivot point relative to the lifting posts is selected so that about half of the total vertical travel of the support post that is needed to remove the spikes from the ground is completed by the time the lever arm reaches a horizontal position.

However, it will also be apparent the available leverage will be greatest when the lever arm is close to horizontal, and the greatest leverage is likely to be needed at the beginning of the lifting operation. Consequently, the height of the pivot point relative to the height of the support posts can be selected so as to balance the need for room to rotate the lever arm for full motion, and the need for greatest leverage at the beginning of the removal operation.

It will also be apparent that because the lever arm 54 pivots, the forked hook will tend to move along an arcuate path as the user pushes down on the handle end 64. This can tend to push the support post laterally as it is lifted. Slight lateral deflection of the support post can be desirable during removal, depending on the characteristics of the soil into which it has been driven. However, the present invention allows the user to eliminate lateral motion of the engagement end of the lever arm if desired by slight movement of the top of the column back and forth, as indicated by arrow 82, during the lifting motion. As the lever arm moves from its initial position with the handle raised (as shown in FIG. 2) toward the horizontal, the forked hook will tend to push the support post away from the user. During this motion, the user can counter this tendency by pulling the top of the column slightly away from the support post toward a tilted position 84, indicated by dashed lines in FIG. 2.

Conversely, as the user continues to rotate the handle 64 of the lever arm 54 down so that the forked hook 74 rotates upwardly, this will tend to pull the support post 12 toward the user as it continues to lift it out of the ground 28. During this part of the motion, the user can rotate the top of the column 52 from the tilted position 84 back toward the support post, again countering lateral movement of the engagement end. The result of this process is that a user can cause the lift slots 76 to move through a substantially vertical motion, with little or no lateral translation, rather than move through an arcuate path. This allows the user to apply substantially only a vertical lifting force upon the support post when removing it, without imposing other forces.

Another advantageous feature of the invention is the placement of the lifting posts 72 upon the support post 12. As shown in FIGS. 1 and 3, the lifting posts are disposed on opposing sides of the support post so as to be substantially parallel with the base plate 24. This arrangement causes a user to remove the support post from a side of the support post away from the base plate. In other words, if the lifting posts were perpendicular to the base plate, the proper place to position the ground plate 60 of the removal device 50 would be along the line of the base plate. Depending upon the length of the base plate, this could cause a user to unintentionally place the ground plate of the removal device upon the base plate itself, rather than on the ground. This is especially possible if the base plate is obscured by dirt, snow, or other debris. Naturally, the support post cannot be removed from the ground if the column is placed against the base plate, rather than the ground. In such a situation, force upon the lever arm would simply tend to bend the base plate relative to the support post tube. Advantageously, with the lifting posts disposed parallel to the base plate, the user will necessarily place the removal device on a side of the support post away from the base plate in order to engage the lifting posts.

Figure 6:
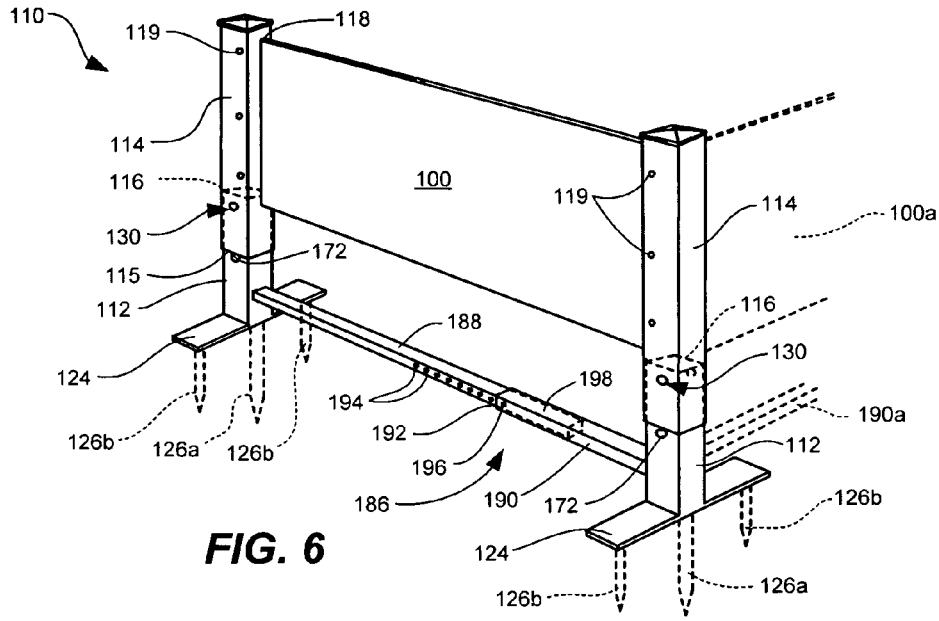
FIG. 6 is a perspective view of an alternative sign support system in accordance with the present invention, the sign support including two support posts.
Figure 7:
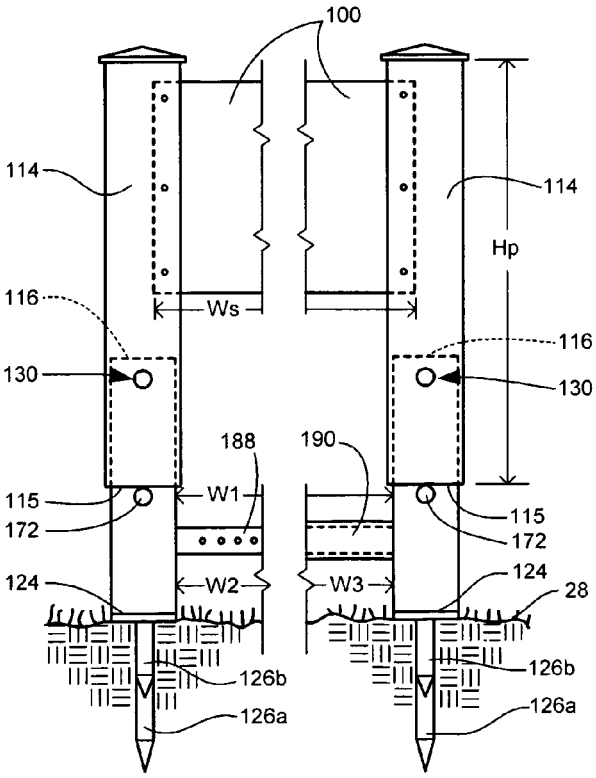
FIG. 7 is a front view of the sign support system of FIG. 6.

Another embodiment of the invention is shown in FIGS. 6–10. With reference to FIGS. 6 and 7, this embodiment is intended for use with larger signs 100 having two or more upright sign posts 114, and provides a removable sign support system, indicated generally at 110, comprising multiple upright support posts 112, to which the sign posts are removably attached. The upright support posts comprise a metal tube, such as a 2" to 4" square steel tube as shown, with a central aperture 116 that is open at its top. The sign posts 114 are of the same general shape as the support posts (e.g. square, round, hexagonal, etc.), and have an open lower end 115 configured to telescopically slide over the top of the support posts. In the embodiment shown, the sign posts are sections of 2½" to 4½" square vinyl tubing, such as is commonly used for vinyl fences.

The sign posts 114 include sign panel slots 118 that are configured to receive the side edges of the relatively large sign 100. The exact size and shape of the sign may vary. A rectangular sign having a width Ws of from about 3'-6" to 6'-6" could be used with this sign support system, and may be supported by sign posts having a total height $H_p$ of from about 4'-0" to about 7'-0". The sign need not be a solid panel, and/or may include features such as holes (not shown) to allow wind to pass through. Fasteners 119, such as screws or bolts, may be used to secure the edges of the sign in the sign panel slots.

Fixedly attached to the bottom of the support posts 112 are transverse base plates 124, each with several downwardly directed ground spikes, indicated generally at 126, for penetrating into the ground 28. In the embodiment shown, the ground spikes are round spikes, and include a longer center spike **126*a* directly below the support tube, and two shorter stabilizer spikes 126*b* located at opposing extremities of the base plate. As an example, the longer center spike may have a length $L_1$ of about 14" to 16", while the shorter spikes have a length $L_2$ of about 7" to 8". Other spike lengths and configurations may also be used. These spikes secure the upright support posts in the ground, and help resist overturning moments due to wind, impact, and other forces. As shown in FIGS. 1 and 2, the base plates are preferably oriented substantially transverse to the plane of the sign 100**.

The support posts 112 may have a total height $H_1$ of from about 2'-0" to about 4'-0", and a length $H_2$ of the support post extending into the open lower end 115 of the sign post 114 for strength and stability. The support posts are configured as mating pairs, with an adjustable transverse brace 186 therebetween, substantially aligned with the plane of the sign 100. The transverse brace secures the two support posts together and provides increased strength to the sign, and also helps ensure that the support posts are properly spaced and aligned relative to each other, so as to be able to receive the sign posts 114. The transverse brace is also telescopically adjustable, allowing a variety of sign widths to be accommodated by the sign support system. The brace comprises two telescoping members, such as sections of similarly shaped tubular steel, specifically an inside brace member 188, and an outside brace member 190, that are adjustably connectable together. In the embodiment of FIGS. 6 and 7, the inside brace member 188 extends from the left side (as per the view in the drawings) support post 112, while the outside brace member 190 extends from the right side support post 112.

The inside brace member 188 is configured to telescopically slide into the open distal end 192 of the outside brace member 190, and includes a plurality of transverse connecting holes 194 disposed along its length. The outside brace member includes at least one transverse locking hole 196, preferably disposed near the open distal end. With the inside brace member inserted into the outside brace member and telescopically adjusted to the desired location, a locking pin, bolt, etc. 198 can be extended through the locking hole and the corresponding connecting hole to connect the support posts together at one of many possible spacings.

Figure 8:
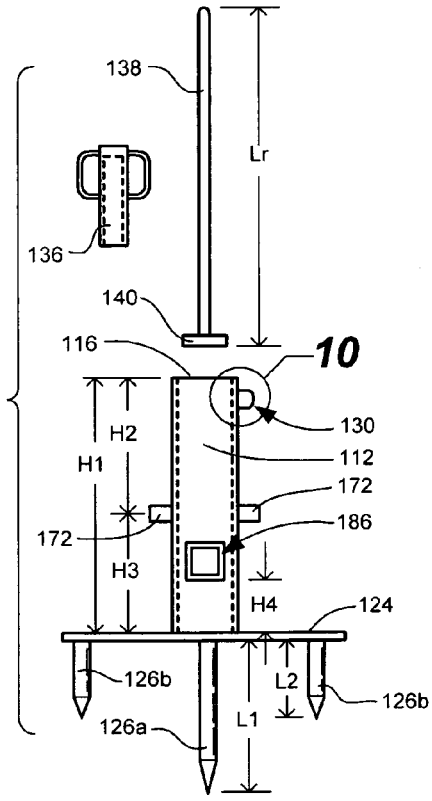
FIG. 8 is a side view of one embodiment of the support post, and a driving rod and post hammer configured for use with the sign support system of FIG. 6.

As shown in FIG. 8, the adjustable transverse brace 186 is connected to the support posts 112 at a height $H_4$ above the base plate, so as to pass over or avoid, if possible, irregularities that there might be in the ground surface between the support posts at a given installation. The height $H_4$ may vary, such as in the range of from about 6" to about 1'-0". Other heights are also possible. The inside and outside brace members may have respective lengths $W_2$ and $W_3$ of from, for example, about 2'-0" to about 3'-6". When telescopically interconnected as shown, the total spacing $W_1$ between the support posts may be in the range of from about 3'-0" to about 6'-0". Referring to FIG. 6, the support post may be alternatively configured as a corner support post, with a second transverse brace member 190*a*, shown in dashed lines, extending at an angle to the first. This configuration allows a corner sign post to be configured to support a second sign panel 100*a* at an angle to the first, in conjunction with another support post and sign post (not shown).

Disposed a distance $H_3$ above the base plate 124 are a pair of stop posts 172 extending from opposing sides of the support post. The height $H_3$ may be, for example, from about 1'-0" to about 3'-0". The stop posts serve at least two purposes. First, as shown in FIGS. 1 and 2, they provide a support stop for abutting the bottom extremity of the sign posts 114. When the sign posts are slid over the tops of the support posts 112, they slide down until they abut the posts. As noted above, this provides a length $H_2$ of the support post extending into the sign post. Second, the stop posts 172 also operate as lifting posts for removal of the support post, as described in more detail below.

Near the top of each upright support post 112 is a detent mechanism 130 for assisting in positioning and holding the sign post 114 upon the support post. The exact configuration of the detent mechanism is shown in more detail in FIG. 10. The detent mechanism includes a spring-loaded detent pin 132 slidably disposed in a detent hole 134 extending through the side wall 113 of the upright support post 112. The detent pin is connected to the inside of the side wall of the support post via a detent spring 133. The lower end of the tubular sign post 114 includes a corresponding detent hole 135, into which the detent slides under the force of the detent spring when the sign post is properly aligned. When the detent pin slides into place, in the direction of arrow 137, this interlocks the support post and sign post in relative position with each other, as shown on the left side of FIG. 10. However, viewing the right side of FIG. 10, when the detent pin is pushed toward the interior of the support post against the force of the detent spring, in the direction of arrow 139, the sign post is free to slide vertically relative to the support post, allowing the sign post to be placed upon or removed from the support post. Advantageously, the exposed top end of the detent pin is rounded and relatively smooth, such that it slides easily against the inside surface of the sign post tube, notwithstanding that it presses against the inside of the sign post as it slides.

Insertion of the support posts 112 into the ground 28 is accomplished in essentially the same manner as described above. Referring to FIG. 8, the support post can be set in the ground using a post hammer 136, like that described above, and a steel driving rod 138. In the embodiment of FIG. 8, the driving rod includes a bottom plate 140 that provides a larger surface area for contact with the base plate 124. This is desirable because of the larger interior size of the support post. The larger size of the embodiment of FIGS. 6–10 suggests that greater force will be required to drive it into the ground. This greater force on the driving rod may be enough to dent or deform the base plate if the force of the driving rod is applied to too small an area. The total length $L_R$ of the driving rod is preferably selected to extend far enough above the top of the support post so that the bottom of the post hammer will not reach or contact the support post during driving, as discussed above. This length may be from about 3'-6" to about 5'-6", for example.

To drive a support post 112 into the ground, the driving rod 138 is inserted into the central aperture 116 of the support post, bottom plate 140 first, until the bottom plate contacts the base plate 124 inside the support post. The top of the driving rod is then pounded downwardly with the post hammer 136 or other driving tool. When installing a sign support system as depicted in FIGS. 6 and 7, it may be desirable to interconnect opposing support posts using the transverse brace 186 before driving the spikes 126 of either support post into the ground. Thereafter, the respective support posts may each be driven into the ground incrementally, to produce the completed installation.

Figure 9:
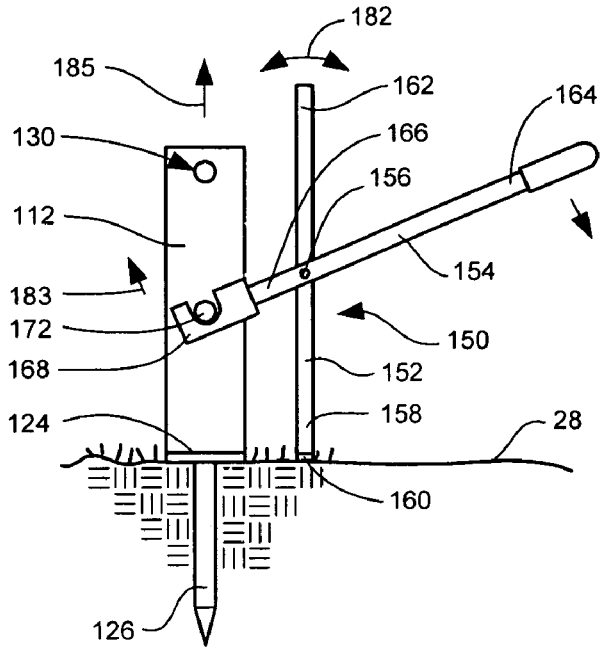
FIG. 9 is a side view of the support post engaged with the lever arm of the sign removal device.
Figure 10:
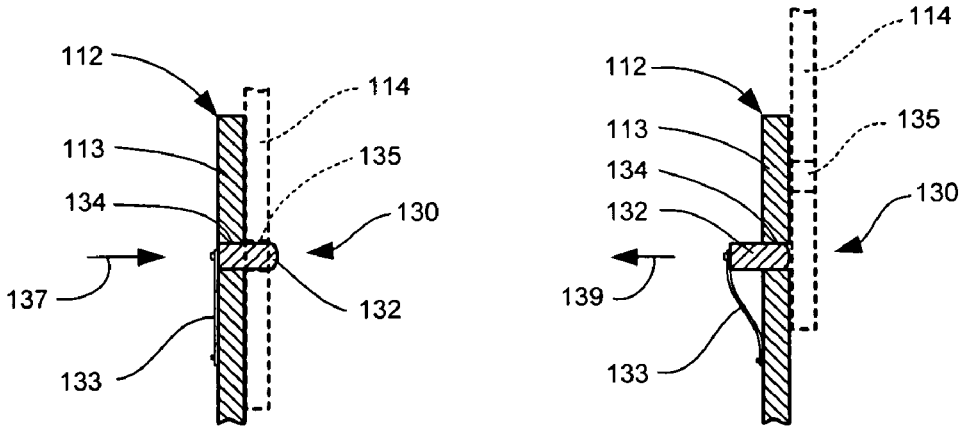
FIG. 10 is a cross-sectional detail view showing the operation of the detent pin for interlocking with a sign post.

Referring to FIG. 9, the removable sign support system includes a sign removal device 150 like that described above. The removal device includes a portable or moveable column 152, with a lever arm 154 pivotally attached thereto at a pivot point 156. The bottom end 158 of the column includes a ground plate 160 configured to support the column on the surface of the ground 28. The top end 162 of the column extends a distance above the pivot point, and provides a convenient location for a user to grip the column to hold it and steady it.

The lever arm 154 includes a handle end 164 on one side of the pivot point 156, and an engagement end 166 on the opposite side of the pivot point. The engagement end includes a forked hook 168, like that described above, that is configured to engage the stop posts 172 extending from opposing sides of the support post 112. As noted above, in one embodiment, the length from the pivot point to the handle end is approximately twice the length from the pivot point to the engagement end, so as to provide substantial mechanical advantage. The support post is removed from the ground using the removal device in the same manner as described above. Because of the lower total height $H_1$ of the support post and the lower height $H_3$ of the stop posts compared to the embodiment of the support post of FIGS. 1 and 2, it will be apparent that the height of the pivot point above the ground 28 should be less for the embodiment of the removal device 150 in FIG. 9 than for the removal device 50 shown in FIG. 2.

As with the prior embodiment, the stop posts 172 are symmetrically disposed on opposite sides of the support post 112, such that simultaneous upward force on these posts imposes a substantially upward force on the support post, as described above. This can be further facilitated by the user tipping the column 152 backward or forward, as indicated by arrow 182, during the lifting motion, so as to counter the slight lateral motion of the engagement end of the lever arm during the lifting motion, as indicated by arrow 183. This allows the user to apply substantially only a vertical lifting force, indicated by arrow 185, upon the support post when removing it. Additionally, as shown in FIGS. 6–9, the stop posts 172 are disposed on opposing sides of the support post 112 so as to extend out substantially parallel to the base plate 124. This arrangement allows a user to remove the support post from a side of the support post away from the base plate, providing the advantages discussed above.

Figure 11:
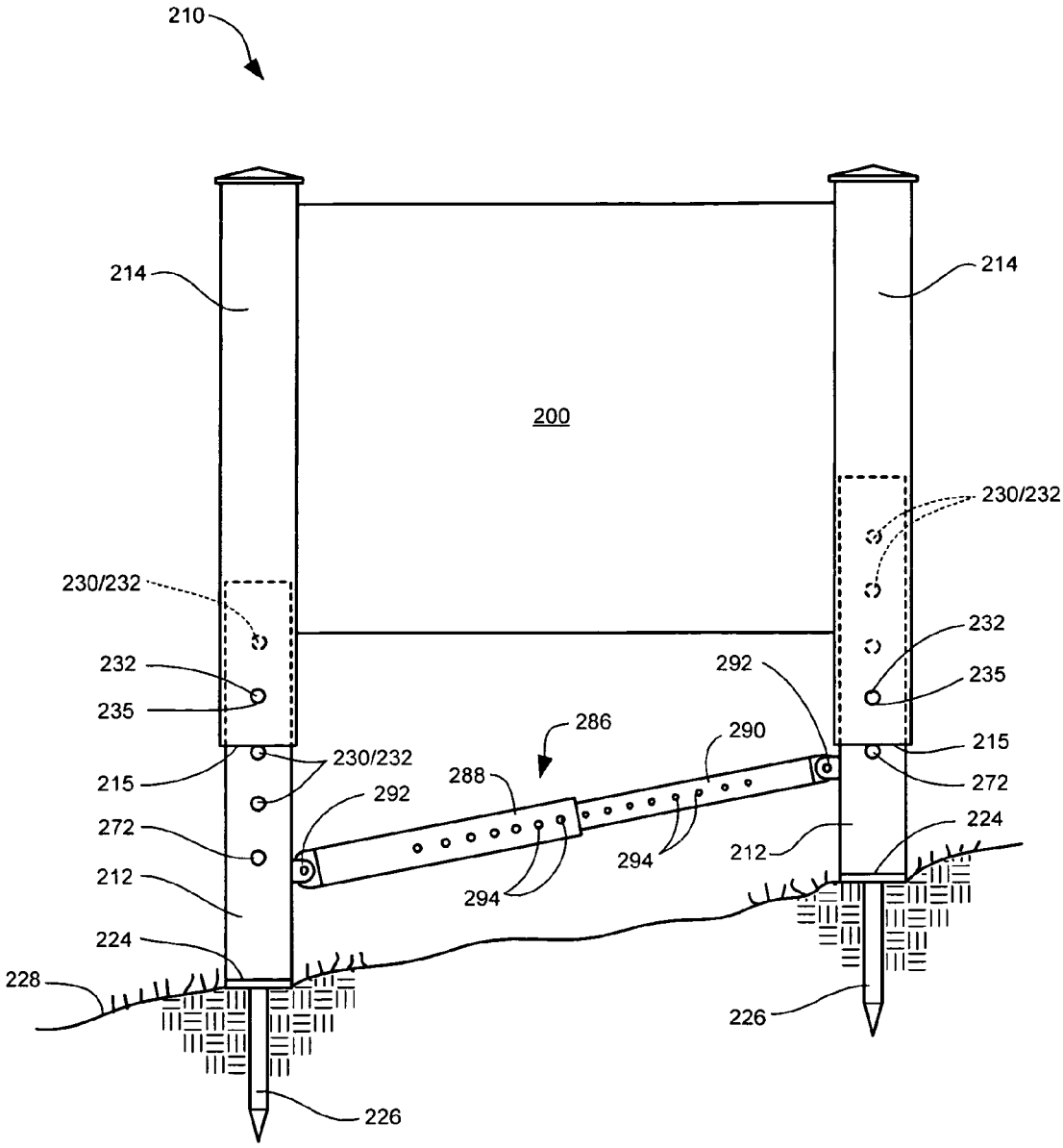
FIG. 11 is a front view of an alternative embodiment of a sign support system having two support posts.

Yet another embodiment of a sign support system 210 having multiple support posts is shown in FIG. 11. This embodiment is similar to that of FIG. 6, but is configured for installation on sloped ground 228. In this embodiment, the sign 200 has two or more upright posts 214, configured to be supported on multiple upright support posts 212, to which the sign posts are removably attached. As in the above-described arrangements, the upright sign posts 214 comprise a tube that is of the same general shape as the support posts 212, having an open lower end 215 configured to telescopically slide over the top of the support posts. The upright sign posts support the sign panel in the manner described above.

Fixedly attached to the bottom of the support posts 212 are transverse base plates 224, each with several downwardly directed ground spikes, indicated generally at 226, for penetrating into the ground 228 as described above. The support posts are configured as mating pairs, with an adjustable transverse brace 286 therebetween, substantially aligned with the plane of the sign 200. The transverse brace serves the functions described above with respect to the transverse brace 186 of the embodiment of FIG. 6. The transverse brace 286 is telescopically adjustable, allowing a variety of sign widths to be accommodated by the sign support system. The brace comprises two telescoping members 288, 290 that are adjustably connectable together, one member being configured to telescopically slide into the open distal end of the other member, and to be releasably fixed at a desired location by inserting a bolt or the like through corresponding pairs of transverse connecting holes 294.

Advantageously, the transverse brace members 228 and 290 are each pivotally attached to their respective support posts 212 via a pivot connector 292, rather than being fixedly attached (e.g. by welding) at a right angle to the respective support post. This allows the transverse brace 286 to assume an angled orientation relative to the support posts, to accommodate the sloped ground 228. That is, the transverse brace is configured to interconnect the vertical support posts and allow them to remain substantially vertically oriented even when the two support posts are disposed at different elevations. The substantially vertical orientation of the support posts is needed to allow the sign posts 214 to mount upon the support posts and keep the sign 200 substantially upright. Additionally, it will be apparent that for a given sign width (i.e. lateral spacing between the sign posts 214) the length of the transverse brace will change depending upon the slope of the ground. Thus, the adjustable length of the transverse brace accommodates signs of different sizes and also accommodates different ground slopes.

The adjustable transverse brace 286 is connected to the support posts 212 above the base plate 224, which allows it to pass over or avoid, if possible, any irregularities in the ground surface 228 between the support posts at a given installation. This height may vary, as described above. Similarly, the elevation or position of the stop posts 272 (described below) on the support posts is slightly above the elevation of connection of the transverse brace, so that the bottom end 215 of the sign posts 214 do not slide down and interfere with the transverse brace and vice versa.

As shown in FIG. 11, the length of the support post 212 extending into the open lower end 215 of the sign post 214 varies depending upon the slope of the ground 228. The support posts include a plurality of detent mechanisms 230 disposed at regular vertical intervals along the post. These detent mechanisms include detent pins 232 which are configured to snap into a locking aperture 235 in the sign post, and can be configured as described above and shown in FIG. 10. At the lowermost position below the detents are a pair of stop posts 272 extending from opposing sides of the support post. The stop posts can be fixedly connected to the support posts, defining the lower limit of telescoping of the sign posts over the support posts, and also providing lifting posts for removal of the support post, in the manner described above. The stop posts can be symmetrically disposed on opposite sides of the support posts, such that simultaneous upward force on these posts imposes a substantially upward force on the support post, as described above.

Insertion of the support posts 212 into the ground 228 is accomplished in essentially the same manner as described above, and may include the use of a driving rod and hammer as discussed above. In order to mount the sign 200 on the support posts with the sign in its upright orientation when the height of the support posts varies due to sloped ground, the user slides the sign posts 214 over the support posts and depresses the successive detent pins 232 as needed to allow the posts to slide downward. This can be done on each side until the lower end 215 of the uphill sign post rests upon the corresponding stop post 272, while the lower end of the downhill sign post is allowed to rest upon an undepressed detent pin at an approximately corresponding elevation.

The locking aperture 235 in each sign post 214 is located a distance above the lower end 215 of the post that is the same as the distance between successive detent pins 232. Accordingly, when the sign posts are slid to a position where the bottom of the tube abuts an undepressed detent pin or a stop post 272, the detent pin next above will automatically snap into place through the locking aperture, thus latching the sign post in place. If desired, additional locking apertures can also be provided above the lower locking aperture at corresponding intervals to allow multiple detent pins to lock simultaneously. Removal of the sign posts 214 from the support posts 212 is easily accomplished by depressing the detent pin 232 that extends through each locking aperture 235, and lifting the sign posts upwardly. With this configuration, a length of the support post naturally extends into the lower portion of the sign post, providing stability, as discussed above. It will be apparent that the maximum ground slope that can be accommodated will depend upon the width of the sign and the height and range of adjustability of the support posts with respect to the detent mechanisms and stop posts 272.

It is to be understood that the above-referenced arrangements are illustrative of the application of the principles of the present invention. While the present invention has been shown in the drawings and described above in connection with certain exemplary embodiments(s) thereof, numerous modifications and alternative arrangements can be devised without departing from the scope of the invention. It will be apparent to those of ordinary skill in the art that numerous modifications can be made without departing from the principles and concepts of the invention as set forth in the claims.

What is claimed is:

1. A removable sign support system for supporting a sign on ground, comprising:

a) at least two substantially upright support posts, each configured to removably receive a sign post, each having a substantially horizontal base affixed to a bottom thereof, a plurality of spikes downwardly extending from the base into the ground, and a lifting connection fixedly attached to the support post;

b) a removal device, including a moveable column having a bottom end configured to bear upon a top surface of the ground near the base of either of the at least two support posts, and a lever arm pivotally attached to the moveable column at a pivot point, the lever arm being configured to pull the spikes upwardly out of the ground when rotated, by engaging and applying a substantially upward force upon the lifting connection; and c) an adjustable transverse brace interconnecting the at least two support posts, configured to help align the support posts for receiving the sign posts thereon.

2. A removable sign support system according to claim 1, wherein the lifting connection comprises a pair of lift pins disposed on opposing sides of each of the support posts, and wherein the lever arm further comprises a forked hook, configured to engage the pair of lift pins.

3. A removable sign support system according to claim 2, further comprising at least two sign posts, each configured to removably slide over a top portion of one of the at least two support posts and abut against the respective lift pins, and a sign, attached between the at least two sign posts.

4. A removable sign support system according to claim 3, further comprising a detent, including a spring-biased detent pin, associated with a top portion of each support post, and a detent hole, associated with a lower portion of each sign post, the detent pin configured to engage the corresponding detent hole when the corresponding sign post is slid over the support post to a point of abutment against the lift pins, so as to secure the sign post with respect to the support post.

5. A removable sign support system according to claim 4, further comprising a plurality of detents associated with a top portion of each support post and disposed at varying heights, such that the sign post can be selectively secured at one of a plurality of elevations with respect to the support post.

6. A removable sign support system according to claim 1, further comprising:

a) a driving rod, having a top end and a bottom end, configured to be inserted into the support post with the sign post removed therefrom, such that the bottom end contacts the horizontal base, and the top end extends above a top end of the support post; and b) a hammer, configured to strike the top end of the driving rod, so as to drive the base and spike into the ground.

7. A removable sign support system according to claim 1, wherein the transverse brace further comprises oppositely oriented brace members attached to each support post, the brace members being configured to telescopically mate with each other and to be connected at a desired position to place the support posts a desired distance apart.

8. A removable sign support system according to claim 7, wherein the oppositely oriented brace members are pivotally attached to their respective support posts, so as to accommodate installation of the sign support system on sloped ground.

9. A removable sign support system according to claim 1, wherein the lever arm comprises an engagement end on one side of the pivot point, configured to engage the lifting connection, and a handle end disposed on an opposite side of the pivot point, the handle end having a length that is approximately twice a length of the engagement end.

10. A removable sign support system according to claim 1, wherein the lifting connection is disposed at first distance above the ground, and the pivot point is disposed a second distance above the ground, the second distance being greater than the first distance.

11. A removable sign system, comprising:

a) a sign support, including i) two substantially upright support posts, each having a bottom end and a top end, the top end configured to removably receive a sign post thereon;

ii) a base, affixed to the bottom end of each support post and extending laterally therefrom, having a plurality of spikes downwardly extending therefrom, for securing the support post in ground;

iii) an adjustable transverse brace interconnecting the two support posts; and iv) a removal connector, fixedly disposed on each tubular support post; and b) a sign removal device, including i) a moveable column, having a bottom end configured to bear upon a surface of the ground; and ii) a lever arm, pivotally attached to the moveable column, having a handle end and an engagement end, the engagement end configured to engage and apply a substantially upward force upon the removal connector of each support post, so as to be suitable for removing the spikes of each support post from the ground.

12. A removable sign system according to claim 11, further comprising a plurality of detent mechanisms, each including a spring-biased detent pin, disposed at varying heights on atop portion of each support post, and a detent hole, associated with a lower portion of each sign post, the detent pins configured to engage the corresponding detent hole when the corresponding sign post is slid thereover, such that each sign post can be selectively secured at one of the plurality of elevations with respect to the support post.

13. A removable sign system according to claim 11, wherein the removal connector comprises of a pair of lift pins, disposed on opposing sides of each support post, and wherein the lever arm further comprises a forked hook, configured to engage the pair of lift pins.

14. A removable sign system according to claim 11, further comprising:

a) two sign posts, each configured to be removably slid onto a top portion of each support post; and b) a sign, attached between the two sign posts.

15. A removable sign system according to claim 11, wherein the adjustable transverse brace is pivotally connected between the upright support posts, so as to accommodate installation of the removable sign system on sloped ground.

16. A removable sign support according to claim 11, further comprising:

a) a driving rod, having a top end and a bottom end, configured to be inserted into each support post with the respective sign post removed therefrom, such that the bottom end contacts the horizontal base, and the top end extends above a top end of the support post; and b) a hammer, configured to strike the top end of the driving rod, so as to drive the base and spikes into the ground.

17. A method for placing and removing a temporary sign support post in ground, comprising the steps of:

a) driving a base with a plurality of spikes and an attached substantially vertical support post into the ground by inserting a driving rod into the support post so as to contact a bottom end of the driving rod with the base, and pounding a top end of the driving rod with a hammer, so as to drive the base and spikes into the ground;

b) engaging a lever arm upon diametrical lifting points on the vertical support post while placing a fulcrum associated with the lever arm upon the ground near the base; and c) pulling spikes from the ground by rotating the lever arm and applying a substantially vertical force upon the diametrical lifting points.

18. A method in accordance with claim 17, wherein the step of engaging the lever arm upon a diametrical lifting point on the vertical support post further comprises engaging a pair of lift pins disposed on opposing sides of the support post with a forked hook disposed on the lever arm.

19. A method in accordance with claim 17, further comprising the steps of:

d) attaching a sign to a top end of the support post; and e) removing the sign from the top end of the support post before engaging the lever arm and pulling the spikes from the ground.

20. A method in accordance with claim 19, wherein the step of attaching the sign to the top end of the support post comprises telescopically sliding a sign post over the top end of the support post, and engaging a detent mechanism at a selected height on the support post.

21. A method in accordance with claim 17, further comprising the step of:

f) tilting a vertical column that is pivotally connected to the lever arm, while rotating the lever arm, so as to cause an engagement end of the lever arm to move substantially vertically while the lever arm is rotated.

* * * * *